United States Patent [19]

Jaeger

[11] Patent Number: 4,655,421

[45] Date of Patent: Apr. 7, 1987

[54] METHOD FOR THE TRANSMISSION OF INFORMATIONS AND/OR INSTRUCTIONS

[76] Inventor: Walter Jaeger, Bel Bosco, CH-6951 Cureglia, Switzerland

[21] Appl. No.: 674,928

[22] PCT Filed: Feb. 16, 1984

[86] PCT No.: PCT/CH84/00022

§ 371 Date: Oct. 23, 1984

§ 102(e) Date: Oct. 23, 1984

[87] PCT Pub. No.: WO84/03264

PCT Pub. Date: Aug. 30, 1984

[30] Foreign Application Priority Data

Feb. 21, 1983 [CH] Switzerland ..... 949/83

[51] Int. Cl.[4] ..... B61L 3/00

[52] U.S. Cl. ..... 246/167 R; 246/182 R

[58] Field of Search ..... 246/122 R, 167 R, 169 R, 246/182 R, 63 R

[56] References Cited

U.S. PATENT DOCUMENTS

| | | | |
|---|---|---|---|
| 3,787,679 | 1/1974 | Birkin et al. | 246/167 R |
| 4,038,653 | 7/1977 | Brewster | 246/63 R |
| 4,491,967 | 1/1985 | Kobayashi et al. | 246/167 R |

FOREIGN PATENT DOCUMENTS

| | | | |
|---|---|---|---|
| 2312953 | 9/1973 | Fed. Rep. of Germany | 246/167 R |
| 2633089 | 1/1978 | Fed. Rep. of Germany | 246/182 R |
| 2643134 | 3/1978 | Fed. Rep. of Germany | 246/167 R |

OTHER PUBLICATIONS

Electronics, vol. 41, booklet 8, 15 Apr. 1968, New York (US), Electronic Abroad; "Track Record", p. 275.

*Primary Examiner*—John W. Caldwell, Sr.
*Assistant Examiner*—David A. Okonsky
*Attorney, Agent, or Firm*—Eric P. Schellin

[57] ABSTRACT

In order to transmit in a simple manner in a railway system informations from a ground station provided at the rail level to a railway vehicle, a plurality of transmitters (5) and receivers (4) are arranged one after the other in the longitudinal direction of the railway track and are used as coding elements (1,2,3) of a coding group and cooperate individually and one after the other with a code converter (9) upon the passage of a vehicle on the rails provided with a corresponding code converter (9)-like ground station. The isolated coding elements (1,2,3) comprised of transmitter (5) and receiver (4) form the parts of a resonant circuit which is synchronized with the frequency of the code converter (9) and which draws the whole energy required for its return from the transmission power of the code converter (9).

19 Claims, 4 Drawing Figures

METHOD FOR THE TRANSMISSION OF INFORMATIONS AND/OR INSTRUCTIONS

This invention relates to a method for transmitting information and/or commands between a ground station located in the vicinity of a railway track and a terminal located aboard a railway vehicle.

Fixed or switch selected visual signals are already known, but these have the disadvantage of being easily overlooked and of having no direct control upon the rail vehicle itself. Also known are signalling devices operating by electrical induction, but these have the disadvantage of being extraordinarily complex and are therefore used almost entirely for main lines only. Both types have limited information transmitting capacity and limited reliability.

It is task of the present invention to provide a method for transmitting information and/or commands to a rail vehicle which does not entail these disadvantages.

According to the present invention, this task has been solved by a method of the kind described in the introduction hereto, in that a plurality of transmitters and receivers are arranged one after the other in the longitudinal of the railway track, which upon the passage of the rail vehicle provided with a transcoder terminal cooperate individually and one after the other with this transcoder as coding elements of a coding group, and obtaining an information and/or command from the pulse sequence formed thus.

In this connection, it is desirable to use on the rail vehicle a transcoder having, locally separated from each other, at least one code feeder and one code scanner, and the coding group consists of a plurality of coding elements arranged one after the other in the longitudinal direction of the railway track, whereby each of these elements having a receiver and a transmitter coupled together and separated locally from each other.

In order to simplify installation, it is desirable that each coding element consists of a receiver and a transmitter which form a part of an oscillatory circuit which is tuned to the frequency of the rail vehicle transcoder and which draws its total energy requirement required for retransmission from the power transmitted by the transcoder. In order to avoid possible sabotage problems, and to avoid increasing the number of different signals to be transmitted, it is desirable for the transcoder or interrogator scanner to be tuned both to the frequency and to the phase of the code signal retransmitted relative to the signal transmitted by the transcoder.

For the purpose of differentiating the information or command, it is especially simple if the phase is altered as between the received and transmitted signal in the case of at least a part of the code elements of a code group. In this connection it is desirable always to alter the phase of at least one code element of a code group, by adjusting the transceivers for example by remote control or by hand. The further processing of the signals in a computer is simplified, if a binary signal system is used, by altering the phase difference between the received and transmitted code signal is either left unaltered or rotated through 180° by the coding element.

In order to provide signals which are the same in both directions of travel, it is desirable for the code formed by a code group to be internally symmetrical.

To provide rugged coding elements and to eliminate, as far as possible, interference effects, it is desirable to operate with electro-magnetic induction transmission, the transcoder frequency selected being between 100 Hz and 100 KHz, and preferably not a harmonic of the frequency of electrical power used by the rail vehicle or of high tension lines in the vicinity of the track.

An extremely reliable system can be built up by using a fail safe coding group system, in which coding groups are used which transmit to the transcoder the distance to the next coding group and which initiates in the transcoder a monitoring of the arrival of a transmission from the next coding group at the predetermined location along the route.

In order to avoid major installation work, it is possible to arrange a coding group adjacent a visual signal, in which case at least one of the code elements of the associated coding group is simultaneously controlled with this visual signal so that the phase of the retransmitted code signal is altered in relation to the code signal transmitted by the transcoder.

In order to increase the safety of the system, it is desirable for the rail vehicle to be provided with two transcoders and with a comparison circuit connected thereto so that when the output signals from the two transcoders do not coincide, a warning signal is generated.

Since a railroad demands a maximum of safety, the status of the system may be subjected to continuous automatic self checking, in that the presence of a weak signal transmitted directly by the transcoder is monitored continuously by its scanner.

The invention is explained hereinbelow, by way of example, with reference to the attached drawings, wherein:

FIG. 1 diagrammatically illustrates the invention in use on a railroad;

Figure 1:
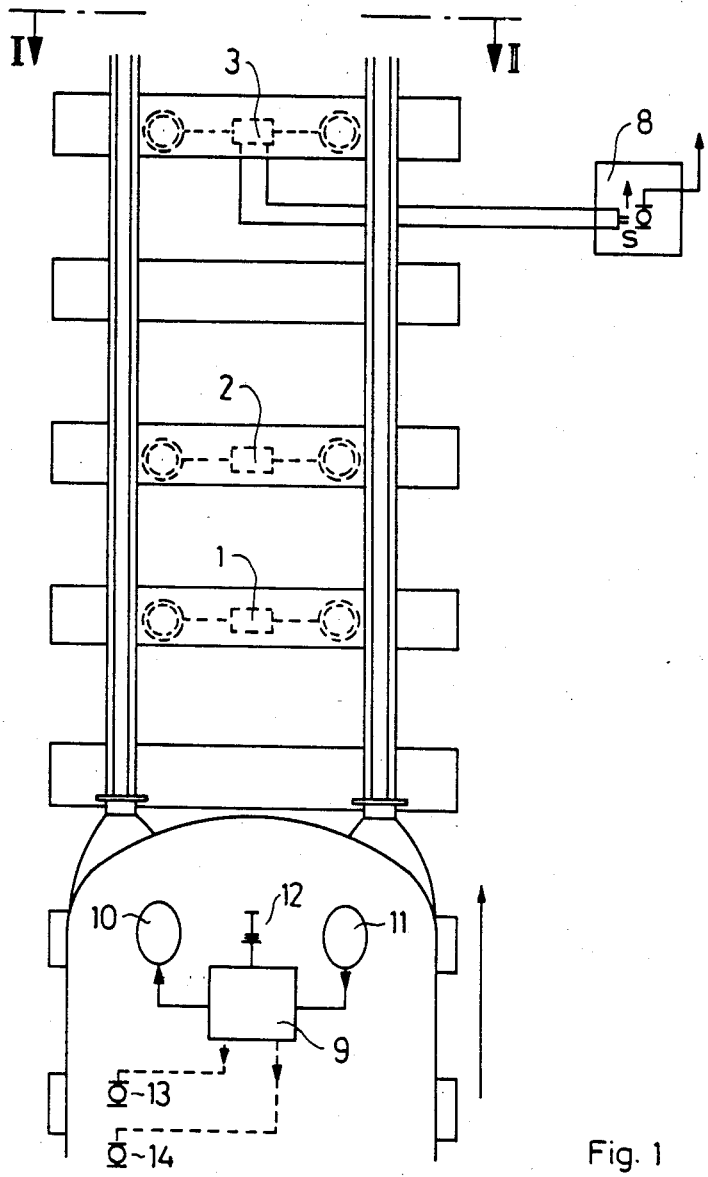
Figure 2:
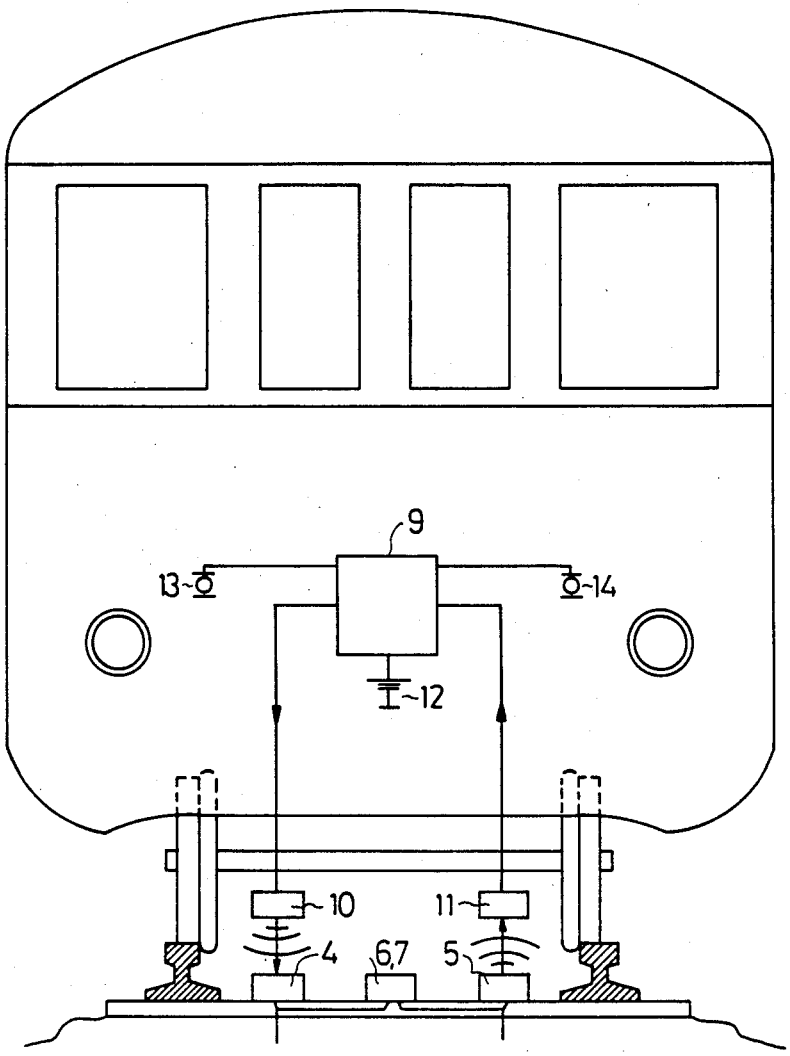
FIG. 2 is a view along the line II—II in FIG. 1.
Figure 3:
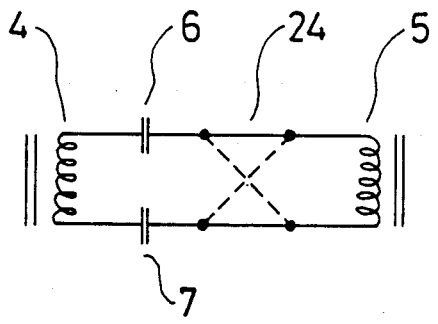
FIG. 3 is a schematic representation of a transceiver element.

As may be seen from FIGS. 1 and 2, a series of coding elements 1,2, 3, forming a coding group, is arranged upon the track ties. As illustrated diagrammatically in FIG. 3, the coding elements each comprise a receiving coil 4 and a transmitting coil 5 connected together electrically through capacitors 6,7. The coils 4 and 5 and capacitors 6 and 7 are such selected that the oscillating circuit formed by them resonates at the frequency used by the transcoder.

The coding element 3 is controlled from a visual signal 8 by means of an electrical signal. To this end it is possible either to alter the capacity ratio of capacitors 6 and 7 or simply to change over the connections to coil 4 by means of a pole changing relay 24.

The transcoder 9 arranged on the rail vehicle feeds a coil 10 which acts as a transmitter to the receiver coils 4 of the coding elements and receives a coded signal from the transmitter coils 5 of the coding elements by means of the coil 11 which acts as code scanner.

The transcoder 9 is fed from the power supply 12, and has outputs which actuate two relays 13, 14 which operate to generate a warning or influence the operation of the train.

Figure 4:
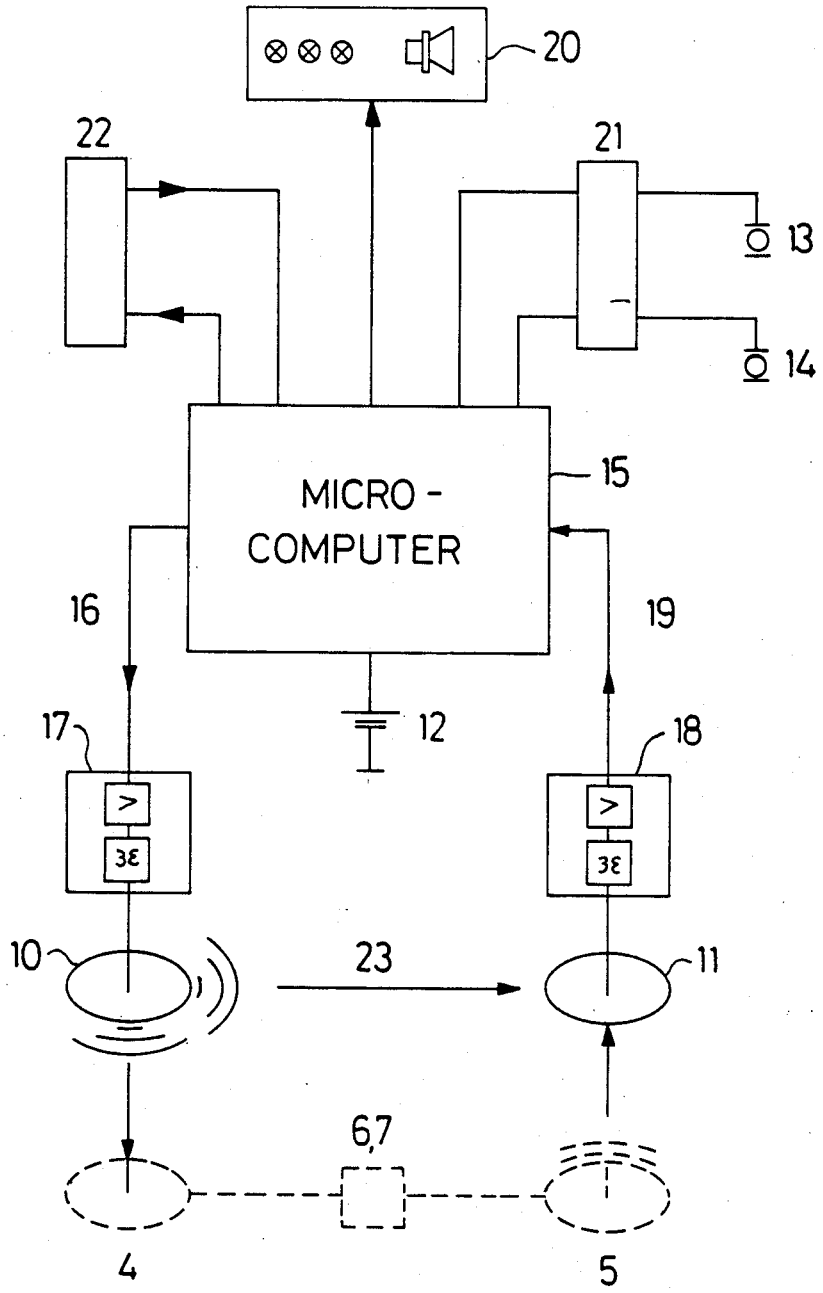
FIG. 4 is a block diagram of a transcoder.

FIG. 4 is a block diagram of the transcoder 9, from which it may be gathered that an alternating current signal produced in a micro-computer 15 is passed, through line 16 and transmitter amplifier 17, to transmitter coil 10.

The signal emitted by the coil 10 is picked up successively by the receiver coils 4 (FIG. 2) of the coding elements 1,2,3 (FIG. 1); the phase is shifted, if necessary according to the code element to be transmitted, and the signal is retransmitted by the transmitter coils 5. This signal is received by scanner coil 11 and is fed, through receiver-amplifier 18 and line 19, back to the micro-computer 15.

The micro-computer 15 may be programmed on receipt of a code group to determine, after a predetermined period of time, whether a predetermined signal is received and, if not, to release a warning or indicating signal to display panel 20 and, if necessary, to actuate relays 13,14 to, for example, control a condition which caused the warning to be released, or to influence the operation of the train.

The micro-computer may also be programmed to monitor continuously the weak direct signal 23 from the coil 10 received by the scanner coil 11 and, in the absence of this signal, to issue a warning.

The relays 13, 14 are driven by signals from micro-computer 15 processed in an interface 21.

The correct functioning of the micro-computer 15 is also itself monitored continuously by a control circuit 22.

I claim:

1. A system for transmitting information commands to a railway vehicle travelling on a railway track, comprising:

at least one ground station located along the railway track;

each said ground station comprising a plurality of passive transponders, electrically independent from each other and spaced apart longitudinally of the track in a predetermined sequence of spacing;

each transponder comprising passive receiving means for receiving electromagnetic oscillations and passive transmitting means electrically connected to said passive receiving means and spaced from the receiving means for retransmitting the received electromagnetic oscillations, all said passive receiving means having the same first geometric relationship to the longitudinal center plane of said railway track and all of said passive transmitting means having a second different geometric relationship to the longitudinal center plane of the track, said two relationships being symmetrical about the longitudinal center plane of said railway tack;

the system further comprising a terminal located on the railway vehicle and comprising at least one transmitter in alignment with said passive receiving means and arranged to transmit electromagnetic oscillations to the passive receiving means of the transponders, and at least one receiver in alignment with said passive transmitting means and arranged to receive the retransmitted electromagnetic oscillations from the passive transmitting means of each transponder as the receiver passes thereby;

whereby the sequence and nature of the signals transponded by said ground station as said railway vehicle travels past said ground station constitutes a code group consisting of individual digits transponded respectively by successive transponders of said ground station;

said code group having information command code meaning and communicating said meaning from said ground station to said railway vehicle; and a decoder on said railway vehicle for decoding the information command code thus received by the receiver.

2. A system as claimed in claim 1 in which the frequency of the electromagnetic oscillations transmitted by the transmitter is between 100 Hz and 100 KHz and, in the case of a railway vehicle driven by alternating electric current, is not equal to an integral multiple of the frequency of the alternating electrical current.

3. A system as claimed in claim 1 in which the transmitted information command code contains the distance to the next ground station and which initiates in the terminal a monitoring of the arrival of a transmission from the next ground station at the predetermined location along the railway track.

4. A system as claimed in claim 1 in which the terminal comprises distance calculating means for calculating the distance between successive transponders.

5. A system as claimed in claim 1 in which the receiver is arranged to receive a portion of the electromagnetic oscillations continuously transmitted by the transmitter, and the terminal includes means for continuously detecting the received portion of the electromagnetic oscillations and for producing an error signal in the absence thereof.

6. A system as claimed in claim 1 wherein the spacing between at least two successive transponders of the ground station is an integral multiple of the distance between the remaining transponders.

7. A system as claimed in claim 1 in which, by virtue of said symmetrical relationship of the passive receiving means and the passive transmitting means about said longitudinal center plane, said passive receiving means and said passive transmitting means interchange their respective functions when the heading of the said railway vehicle traveling on said track is reversed.

8. A system as claimed in claim 1 in which at least one of the transponders comprises means for selectively changing the phase of the received electromagnetic oscillations prior to retransmission, and the decoder means comprises phase change detecting means for detecting whether the phase of the retransmitted electromagnetic oscillations received by the receiver has been altered with respect to the electromagnetic oscillations transmitted by the transmitter.

9. A system as claimed in claim 8 in which the said phase changing means is arranged to change the phase of the received electromagnetic oscillations by 180°.

10. A system as claimed in claim 8 in which the phase of at least one of the transponders in controlled by a visual signal.

11. A system for transmitting information commands to a railway vehicle travelling on a railway tack, comprising at least one ground station located along the railway track;

each said ground station comprising a plurality of passive transponders, electrically independent from each other and spaced apart longitudinally of the track in a predetermined sequence of spacing;

each transponder comprising passive receiving means for receiving electromagnetic oscillations and passive transmitting means electrically connected to and spaced from the receiving means for retransmitting the received electromagnetic oscillations, all said passive receiving means having the same first geometric relationship to the longitudinal center plane of said railway track and all of said passive transmitting means having a second different geometric relationship to the longitudinal center plane of the track, said two relationships being symmetrical about the longitudinal center plane of said railway track;

at least one of the transponders further including alternating means for selectively altering the received electromagnetic oscillations prior to retransmission;

the system further comprising a terminal located on the railway vehicle and comprising at least one transmitter in alignment with said passive receiving means and arranged to transmit electromagnetic oscillations to the passive receiving means of the transponders, and at least one receiver in alignment with said passive transmitting means and arranged to receive the retransmitted electromagnetic oscillations from the passive transmitting means of each transponder as the receiver passes thereby;

whereby the sequence and nature of the signals transponded by said ground station as said railway vehicle travels past said ground station constitutes a code group consisting of individual digits transponded respectively by successive transponders of said ground station;

said code group having information command code meaning and communicating said meaning from said ground station to said railway vehicle;

discriminating means on said railway vehicle for discriminating whether or not the retransmitted electromagnetic oscillations received by the receiver have been altered with respect to the electromagnetic oscillations transmitted by the transmitter; and a decoder on said railway vehicle to decode the thus altered or unaltered retransmitted code.

12. A system as claimed in claim 11 in which the frequency of the electromagnetic oscillations transmitted by the transmitter is between 100 Hz and 100 KHz and, in the case of a railway vehicle driven by alternating electric current, is not equal to an integral multiple of the frequency of the alternating electrical current.

13. A system as claimed in claim 11 in which the transmitted information command code contains the distance to the next ground station and which initiates in the terminal a monitoring of the arrival of a transmission from the next ground station at the predetermined location along the railway track.

14. A system as claimed in claim 11, in which the terminal comprises distance calculating means for calculating the distance between successive transponders.

15. A system as claimed in claim 11 in which the receiver is arranged to receive a portion of the electromagnetic oscillation continuously transmitted by the transmitter, and the terminal included means for continuously detecting the received portion of the electromagnetic oscillation and for producing an error signal in the absence thereof.

16. A system as claimed in claim 11 in which, by virture of said symmetrical relationship of the passive receiving means and the passive transmitting means about said longitudinal center plane, said passive receiving means and said passive transmitting means interchange their respective functions when the heading of said railway vehicle traveling on said track is reversed.

17. A system as claimed in claim 11 in which at least one of the transponders comprises means for selectively changing the phase of the received electromagnetic oscillations prior to retransmission, and the discriminating means comprising phase change detecting means for detecting whether the phase of the retransmitted electromagnetic oscillations received by the receiver has been altered with respect to the electromagnetic oscillations transmitted by the transmitter.

18. A system as claimed in claim 17 in which the or each phase changing means is arranged to change the phase of the received electromagnetic oscillations by 180°.

19. A system as claimed in claim 17 in which the phase of at least one of the transponders is controlled by a visual signal.

* * * * *